US005272038A

United States Patent [19]

Matsubara et al.

[11] Patent Number: 5,272,038

[45] Date of Patent: Dec. 21, 1993

[54] ELECTROSTATIC IMAGE DEVELOPING RESIN-COATED CARRIER AND METHOD FOR PRODUCING THE SAME

[75] Inventors: Akitoshi Matsubara, Machida; Meizo Shirose, Hachioji; Michiaki Ishikawa, Hino; Yoshiki Nishimori; Hiroyuki Takagiwa, both of Hachioji, all of Japan

[73] Assignee: Konica Corporation, Tokyo, Japan

[21] Appl. No.: 757,229

[22] Filed: Sep. 10, 1991

[30] Foreign Application Priority Data

Sep. 14, 1990 [JP] Japan ..... 2-242776

[51] Int. Cl.[5] ..... G03G 9/113

[52] U.S. Cl. ..... 430/108; 428/407; 430/137

[58] Field of Search ..... 430/108; 428/407

[56] References Cited

U.S. PATENT DOCUMENTS

| | | | |
|---|---|---|---|
| 4,614,700 | 9/1986 | Yamamoto et al. | 430/108 X |
| 4,965,159 | 10/1990 | Kohno et al. | 430/108 |
| 5,021,316 | 6/1991 | Kubo et al. | 430/108 |
| 5,075,158 | 12/1991 | Kouno et al. | 430/108 X |

FOREIGN PATENT DOCUMENTS

| | | | |
|---|---|---|---|
| 120155 | 6/1986 | Japan | 430/108 |
| 168273 | 6/1990 | Japan | 430/108 |

*Primary Examiner*—Roland Martin

*Attorney, Agent, or Firm*—Finnegan, Henderson, Farabow, Garrett & Dunner

[57] ABSTRACT

A resin coated carrier for developing an electrostatic image is disclosed. The carrier coating layer comprises a resin copolymerized of at least three fluorinated vinyl monomers. The carrier is useful for developing a negative charged electrostatic image formed on an organic photoreceptor.

18 Claims, 2 Drawing Sheets

ELECTROSTATIC IMAGE DEVELOPING RESIN-COATED CARRIER AND METHOD FOR PRODUCING THE SAME

FIELD OF THE INVENTION

The present invention relates to an electrostatic image developing resin-coated carrier for use in an electrophotographic process, electrostatic recording process and electrostatic printing process, and a method for producing the same, and more particularly to an electrostatic image developing resin-coated carrier for developing a negatively charged electrostatic image formed on an organic photoreceptor.

BACKGROUND OF THE INVENTION

A two-component developer for use in an electrophotographic process is composed generally of a toner and a carrier. The carrier is used for the purpose of giving a proper polarity and a proper amount of triboelectric charge to the toner.

As the carrier, in order to improve its durability and triboelectric chargeability, there is used a resin-coated carrier prepared by coating a resin on the surface of core particles.

Known as the resin-coated carrier are those comprising magnetic particles each having on the surface thereof a fluoro-resin coat phase in order to prevent the adhesion of a toner material to the carrier surface and to render positive triboelectric charge to the toner as disclosed in JP O.P.I. Nos. 208754/1983, 176048/1985, 16617/1985 and 240758/1984.

As means for forming the resin coat layer, a wet spray coating method and a dry coating method are widely known. There is also known a method in combination of both as disclosed in JP O.P.I. No. 13972/1990.

The above technique is for carrier production improvement in which a resin intermediate phase is provided on a carrier core by a dry coating process, and on the intermediate phase is provided a triboelectric charging control resin layer.

However, the carrier needs to be still further improved. The resin used in the triboelectric charging control phase is not sufficient in the adhesion property to the intermediate phase, and the phase is liable to be worn out by the force from the stirring inside the developer vessel, developer carrier, developer regulation member, and the like, so that it is insufficient in the durability. In addition, the triboelectric charge largely changes according to the changes in temperature between 10° C. and 30° C., so that it is difficult to obtain constantly stable images over a long period under various environmental conditions.

SUMMARY OF THE INVENTION

It is an object of the invention to provide a carrier coated with a resin having a good wear resistance.

It is another object of the invention to provide a well-durable carrier capable of giving a stable positive charge even under various environmental conditions at high and low temperatures.

It is a still further object of the invention to provide a method for producing the above-mentioned carrier.

The above objects can be accomplished by a carrier which is coated with a copolymer (A) obtained by copolymerizing three or more different monomers comprised essentially of $$\text{(a)}\quad CH_2{=}\overset{\overset{\displaystyle R}{|}}{C}COOCH_2{-}X{-}H,$$

wherein R is H or $CH_3$, and X is $(CF_2)_n$, wherein n is an integer of 1 to 4, $$\text{(b)}\quad CH_2{=}\overset{\overset{\displaystyle R}{|}}{C}COOCH_2{-}Y{-}F,$$

wherein R is H or $CH_3$, and Y is $(CF_2)_n$, wherein n is an integer of 1 to 4, and (c) at least one monomer selected from among acrylates and methacrylates.

The core material may be coated with the resin (A) directly or through other resin phase formed thereon.

The copolymer (A) may be coated on an intermediate phase comprised of styrene-acrylate or methacrylate copolymer particles formed on the carrier core material by a dry process using mechanical impact force. It is preferable that the copolymer (A) be dissolved in a solvent to form a surface phase by a wet process on the intermediate phase.

The carrier of the invention is very little stained by the toner particles, has a charging characteristic which is stable against a large environmental temperature fluctuation, and can provide a positive charge stably to the toner. This is considered probably because the surface energy on the resin-coated carrier surface is lowered by using (a) and (b). The amount of the positive charge to be provided to the toner can be easily controlled by changing the content ratio of (a) and (b).

By the copolymerization of (c), the copolymer (A) can be made into a stiff and highly wear-resistant resin, so that the resin phase formed does not exfoliate from the carrier even when used over a long period, thus enabling to provide a good resin-coated carrier.

The carrier produced through the dry process of providing the intermediate phase by the impact application has stable characteristics, particularly a remarkably good impact resistance, even when subjected to the impact from the stirring inside the developer vessel. Further, by the wet coating process, the surface phase can be improved to be well-smooth and slidable to thus make it possible to provide to the toner a stable triboelectric charge little affected by changes in the emvironment.

The surface phase coating by use of a solvent improves the adhesion of the surface phase to the intermediate phase, whereby the durability of the carrier can be improved.

DETAILED DESCRIPTION OF THE INVENTION

Figure 1:
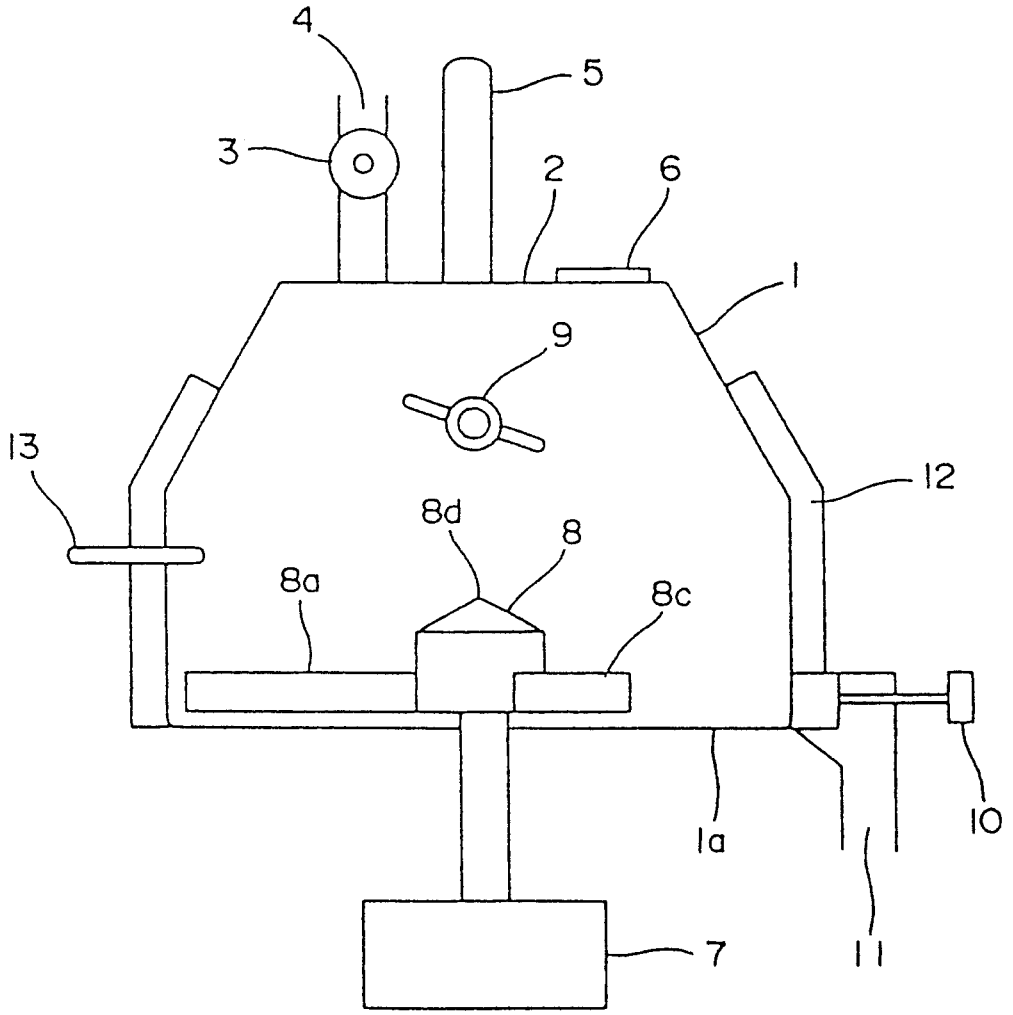
FIG. 1 is an explanatory drawing showing a suitable example of a high-speed stirring-type mixer.

The following are the examples of the monomer (a):

$CH_2{=}CHCOOCH_2CF_2H$ $CH_2{=}CHCOOCH_2CF_2CF_2H$ $CH_2{=}CHCOOCH_2CF_2CF_2CF_2H$ $CH_2{=}CHCOOCH_2CF_2CF_2CF_2CF_2H$ $$CH_2{=}C(CH_3)COOCH_2CF_2H$$

$$CH_2{=}C(CH_3)COOCH_2CF_2CF_2H$$

$$CH_2{=}C(CH_3)COOCH_2CF_2CF_2CF_2H$$

$$CH_2{=}C(CH_3)COOCH_2CF_2CF_2CF_2CF_2H$$

The following are the examples of the monomer (b):

$CH_2{=}CHCOOCH_2CF_3$
$CH_2{=}CHCOOCH_2CF_2CF_3$
$CH_2{=}CHCOOCH_2CF_2CF_2CF_3$
$CH_2{=}CHCOOCH_2CF_2CF_2CF_2CF_3$ $$CH_2{=}C(CH_3)COOCH_2CF_3$$

$$CH_2{=}C(CH_3)COOCH_2CF_2CF_3$$

$$CH_2{=}C(CH_3)COOCH_2CF_2CF_2CF_3$$

$$CH_2{=}C(CH_3)COOCH_2CF_2CF_2CF_2CF_3$$

Examples of the acrylate or methacrylate as the monomer (c) include methyl methacrylate, ethyl methacrylate, propyl methacrylate, butyl methacrylate, isobutyl methacrylate, octyl methacrylate, dodecyl methacrylate, lauryl methacrylate, 2-ethylhexyl methacrylate, stearyl methacrylate, phenyl methacrylate, dimethylaminoethyl methacrylate, dimethylaminoethyl methacrylate, methyl acrylate, ethyl acrylate, butyl acrylate, isobutyl acrylate, propyl acrylate, octyl acrylate, dodecyl acrylate, lauryl acrylate, 2-ethylhexyl acrylate, stearyl acrylate, 2-chloroethyl acrylate, phenyl acrylate and methyl α-chloroacrylate.

The copolymerization ratio of the respective monomer components of the copolymer (A) is preferably as follows: monomer (a) accounts for 5 to 40 wt %, monomer (b) for 30 to 80 wt % and monomer (c) for 5 to 40 wt %. The glass transition point of the copolymer (A) is preferably 80° to 105° C. The weight average molecular weight Mw of the copolymer (A) in styrene equivalent according to GPC measurement is preferably from 200,000 to 1,000,000, and the number average molecular weight thereof is preferably from 50,000 to 500,000 When the copolymer (A) has the characteristics in the above ranges, a carrier having even more stable triboelectricity and good durability can be obtained.

When the integer n in the formulas (a) and (b) is 2, it is advantageous from the production cost point of view. The monomer used as the component (c) is preferably methyl methacrylate. For the polymerization a block polymerization method is preferably used because it can stiffen the copolymer (A), improve the reactivity in the polymerization and easily make the copolymer (A) high molecular.

The resin particles for forming the intermediate phase preferably have a volume average grain size of 0.01 to 5 μm.

The above resin is a styrene-acrylate or methacrylate copolymer. Examples of the styrene moiety include styrene, o-methyl-styrene, m-methyl-styrene, p-methyl-styrene, α-methyl-styrene, p-ethyl-styrene, 2,4-dimethyl-styrene, p-butyl-styrene, p-t-butyl-styrene, p-hexyl-styrene, p-octyl-styrene, p-nonyl-styrene, p-decyl-styrene, p-dodecyl-styrene, p-methoxy-styrene, p-phenyl-styrene, p-chlorostyrene and 3,4-dichlorostyrene.

As the acrylate or methacrylate there may be used those similar to (c) used in the copolymer (A). Particularly the use of the same monomer as the component (c) of the copolymer (A) is preferred for improving the adhesion of the intermediate phase to the surface phase.

The methacrylate component of the copolymer constituting the resin particles of the intermediate phase is preferably methyl methacrylate, which accounts for preferably 30 to 90% by weight of the whole copolymer composition. The proportion of the methacrylate component is determined so as to make the mechanical strength of the resin coat phase and the phase formability of the resin particles most suitable. Particularly, the methacrylate component is selected in consideration of its adhesiveness to the core particles and so as not cause the resin coat phase to crack or exfoliate.

The thickness of the coat phase, including the intermediate phase when present, is 0.5 to 5 μm on the average.

The core material particles of the carrier are preferably magnetic particles. The weight average grain size range of the magnetic particles is preferably 10 to 200 μm in taking into account the triboelectricity of toner and the carrier's adhesiveness to a photoreceptor, wherein the magnetic particles' weight average grain size is a value determined by use of a Microtrack Type 7981-OX, manufactured by LEEDS & NORTH RUP Co.

As the material for magnetic materials there may be used materials strongly magnetizable in its magnetic field direction, including ferromagnetic metals and alloys such as iron, ferrite, magnetite, cobalt, nickel, and the like.

The 'ferrite' is the general term of magnetic oxides containing iron and represented by $MO.Fe_2O_3$, wherein M represents a bivalent metal such as nickel, copper, zinc, manganese, magnesium and lithium.

The intermediate phase of the carrier can be produced by the following dry process. Firstly, core material particles and resin particles are uniformly mixed in an ordinary mixer. Then, to the mixed particles, with its temperature kept at 50° to 110° C. in a high-speed stirring-type mixer, is repeatedly applied impact force for 10 to 60 minutes, preferably 15 to 30 minutes. By such the dry process, the resin particles can be attached onto the core material particles surface to thereby form an intermediate phase thereon.

The impact force applied to the mixture of the core material particles and resin particles should be strong to an extent not to pulverize the core material particles for phase formability improvement.

FIG. 1 is a drawing showing an example of the high-speed stirring-type mixer suitable for the dry process, wherein the top lid 2 of a mixing/stirring vessel 1 has a raw material supply inlet 4 provided with a supply valve 3, a filter 5 and an inspection hole.

Figure 2:
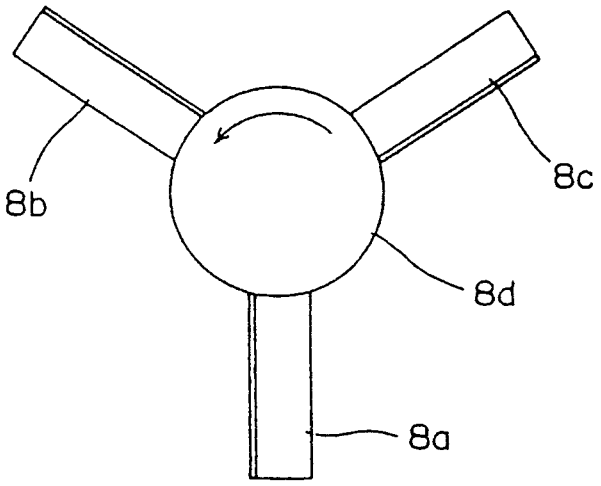
FIG. 2 is a plan view of the horizontally rotating body in the mixter in FIG. 1.

The powdery material supplied through the inlet valve 3 from the material supply inlet 4 is stirred up by the rotary blades 8*a*, 8*b* and 8*c* of a horizontally rotating body 8 driven by a motor 7, whereby mechanical impact force is applied to the supplied material. This horizontally rotating body 8, as shown in FIG. 2, is comprised of central axis 8*d* and three rotary blades 8*a*, 8*b* and 8*c* provided symmetrically with respect to the central axis, and these rotary blades each have a slant rising aslant upward from the bottom 1*a*, so that the supplied raw material is stirred upward by these rotary blades. The material stirred up runs against the obliqued upper part or lower part of the inside wall of the mixing/stirring vessel 1, and then falls into the rotating span of the rotary blades 8*a*, 8*b* and 8*c* of the horizontally rotating body 8. On the other hand, a vertically rotating body 9 is provided above the horizontally rotating body 8. The vertically rotating body 9 consists of two rotary blades which vertically rotate to collide with the material that has rebounded off the inside wall. The vertically rotating body 9 plays the role of accelerating the stirring of the powdery material and preventing its aggregation.

Thus, the material particles repeatedly collide with the horizontally rotating body 8, vertically rotating body 9 and the inside wall of the mixer vessel 1, and also collide with one another, whereby mechanical impact force is applied thereto and the resin particles are attached onto the core material particles to form a resin coat phase of the carrier. The thus obtained coated carrier particles are ejected through ejection valve 10 out of product ejection outlet 11.

Jacket 12 functions as a heating means at the time of stirring the material and as a cooling means after completion of the stirring. The jacket 12 covers ¾ of the height of the external wall of the mixer vessel 1, i.e., the height corresponding to the level where the vertically rotating body 9 is provided. The temperature of the powdery material is measured with a thermometer 13.

The vertically rotating body 9 is provided as needed, so that the horizontally rotating body 8 alone may be provided.

The wet process for the formation of the carrier surface is such that the resin (A) is dissolved in an organic solvent to prepare a coating liquid, the coating liquid is coated on the surface of the intermediate phase particles in accordance with a dipping method, dry spray method or fluidifying bed method, and then the coated phase is heated or allowed to stand to thus form the carrier surface phase.

To be concrete, for example, a fluidifying bed device is used, in which the intermediate phase coating particles are raised up to the equilibrium height by a pressure gas flow, and a coating liquid is sprayed by the time when the grains fall again; this process is repeated, whereby the surface phase can be formed.

As the above organic solvent there may be used any organic solvent as long as it can dissolve the resin, examples of which solvent include acetone, methyl-ethyl ketone, toluene and ethanol.

The resin-coated carrier of the invention is particularly effective when used to develop a negatively charged electrostatic latent image formed on an organic photoreceptor.

The toner to be positively charged by the friction with the resin-coated carrier of the invention can be obtained by adding a positively chargeable hydrophobic silica particles and a fatty acid metal salt particles from outside to particles which comprise a styrene-acrylate or methacrylate copolymer as a binder, a coloring agent or magnetic particles and a charge control agent which is used as needed.

Usable as the styrene constituting the binder is styrene or α-methylene, and usable as the acrylate or methacrylate is methyl methacrylate, butyl acrylate, butyl methacrylate, 2-ethylhexyl-acrylate or 2-methylhexyl-methacrylate.

There may be used carbon black or various known organic pigments as the coloring agent, metallic complex dyes as the charge control agent, silica particles subjected to hydrophobic treatment with a compound having an amino group or an ammonium base as the hydrophobic silica, and zinc stearate as the fatty acid metal salt.

EXAMPLES

In the following examples, the term 'part' or 'parts' means part by weight or parts by weight.

EXAMPLE 1

Core material particles (spherical ferrite powder, volume average particle size: 80 μm) . . . 100 parts Coating resin particles (styrene-methyl methacrylate copolymer having a glass transition point Tg of 105° C., volume average particle size: 2.47 μm) . . . 1.3 parts The above materials were premixed in the high-speed stirring-type mixer shown in FIG. 1, and then the materials with its temperature of raised to 80° C. were further stirred for 20 minutes to repeatedly apply mechanical impact force thereto, whereby an intermediate phase was formed.

After that, a coating liquid prepared by dissolving in 500 ml of acetone 12 g of a copolymer obtained by the block polymerization of $$CH_2{=}\overset{\overset{\displaystyle CH_3}{|}}{C}COOCH_2CF_2CF_2H,\ CH_2{=}\overset{\overset{\displaystyle CH_3}{|}}{C}COOCH_2CF_2CF_3$$

and methyl methacrylate (copolymerization ratio by weight: 20/60/20, glass transition point 89° C., Mw: 510,000, Mn: 230,000), and this liquid was used to form a surface phase on the foregoing intermediate phase by using a spiracoater to thereby form a resin coat phase having an average thickness of about 2 μm, whereby the resin-coated carrier A of the invention was obtained.

Nine hundred and sixty parts by weight of the above resin-coated carrier A was mixed with 40 parts by weight of a toner prepared by adding 0.6% by weight of positively chargeable silica particles subjected to hydrophobic treatment with an aminosilane coupling agent and 0.03% by weight of zinc stearate to 10 μm particles of styrene-butyl acrylate copolymer containing 10% by weight of carbon black, whereby a developer was obtained.

This developer was used in an organic photoreceptor-provided U-Bix 1017, manufactured by KONICA Corp., to perform its durability evaluation through copying tests. The copying tests were made by repeating alternately 20,000 copies-making operations at 10° C./30% RH and at 30° C./80% RH. As a result, no deterioration of the developer was found and clear copy image having a high density was retained even in the durability test for making up to 100,000 copies.

In the developer after making 100,000 copies, when the toner's chargeabilities at the above high and low temperatures were examined, it was found that the difference was as small as 2 $\mu C/g$, thus the environmental stability thereof was retained.

EXAMPLE 2

A resin-coated carrier was prepared in the same manner as in Example 1 except that the copolymerization ratio, glass transition point, Mw and Mn of the surface phase copolymer comprising the same monomers as those for the carrier A in Example 1 were changed to 15/70/15, 87° C., 380,000 and 170,000, respectively, and then, the carrier was subjected to similar evaluation. Consequently, nearly the same good results as those of Example 1 were obtained.

EXAMPLE 3

A resin-coated carrier was prepared in the same manner as in Example 1 except that the copolymerization ratio, glass transition point, Mw and Mn of the surface phase copolymer comprising the same monomers as those for the carrier A of Example 1 were changed to 30/45/25, 93° C., 740,000 and 330,000, respectively, and then the carrier was subjected to similar evaluation. Consequently, nearly the same good results as in Example 1 were obtained.

What is claimed is:

1. A carrier for developing an electrostatic image comprising a core particle, an intermediate resin phase formed by a dry coating process and a resin layer coated on the intermediate layer, wherein the resin layer comprises a copolymer (A) obtained by copolymerizing three or more different monomers comprised of $$\text{(a)}\quad CH_2{=}\overset{\overset{R}{|}}{C}COOCH_2{-}X{-}H,$$

wherein R is H or $CH_3$, and X is $(CF_2)_n$, wherein n is an integer of 1 to 4, $$\text{(b)}\quad CH_2{=}\overset{\overset{R}{|}}{C}COOCH_2{-}Y{-}F,$$

wherein R is H or $CH_3$, and Y is $(CF_2)_m$ wherein m is an integer of 1 to 4, and (c) at least one monomer selected from among acrylates and methacrylates.

2. A carrier according to claim 1 wherein the intermediate phase is styrene-acrylate or styrene-methacrylate copolymer.

3. A carrier according to claim 2, wherein the styrene acrylate or styrene-methacrylate copolymer has an average particle size of 0.01 to 5 $\mu m$.

4. A carrier according to claim 1, wherein the core is a magnetic material having an average diameter of 10 to 200 $\mu m$.

5. A carrier according to claim 1, wherein a total thickness of the resin layer and the intermediate phase is 0.5 to 5 $\mu m$.

6. A carrier for developing an electrostatic image comprising a core particle of a magnetic material having an average diameter of 10 to 200 $\mu m$, an intermediate phase selected from the group consisting of styrene-acrylate or styrene-methacrylate copolymer particles by a dry process using mechanical impact and a resin layer coated thereon, wherein the resin layer comprises a copolymer obtained by copolymerizing three or more different monomers comprised of $$\text{(a)}\quad CH_2{=}\overset{\overset{R}{|}}{C}COOCH_2{-}X{-}H,$$

wherein R is H or $CH_3$, and X is $(CF_2)_n$, wherein n is an integer of 1 to 4, $$\text{(b)}\quad CH_2{=}\overset{\overset{R}{|}}{C}COOCH_2{-}Y{-}F,$$

wherein R is H or $CH_3$, and Y is $(CF_3)_n$, wherein n is an integer of 1 to 4, and (c) at least one monomer selected from the group consisting of acrylates and methacrylates.

7. A carrier according to claim 1, wherein the copolymer (A) comprises the monomer (a) in the range between 5 to 40% based on the weight of the copolymer (A).

8. A carrier according to claim 1, wherein the copolymer (A) comprises the monomer (b) in the range between 30 to 80% based on the weight of the copolymer (A).

9. A carrier according to claim 1, wherein the copolymer (A) comprises the monomer (c) in the range between 5 to 40% based on the weight of the copolymer (A).

10. A carrier according to claim 1, wherein the copolymer (A) has a glass transition point from 80° to 105° C.

11. A carrier according to claim 1, wherein the copolymer (A) has a weight average molecular weight from 200,000 to 1,000,000.

12. A carrier according to claim 1, wherein the copolymer (A) has a number average molecular weight from 50,000 to 500,000.

13. A carrier according to claim 1 wherein n is the same integer as m.

14. A carrier according to claim 1 wherein n and m are each 2.

15. A carrier according to claim 1 wherein the monomer (c) is methylmethacrylate.

16. A carrier according to claim 2, wherein the intermediate phase comprises a styrene-methacrylate copolymer.

17. A carrier according to claim 16, wherein an amount of methacrylate component of the copolymer consisting the intermediate phase is 30 to 90% based on the weight of the copolymer of the intermediate phase.

18. A carrier of claim 1, wherein the intermediate phase is formed by dry process using mechanical impact force.

* * * * *